US008716993B2

(12) United States Patent
Kadanka

(10) Patent No.: US 8,716,993 B2
(45) Date of Patent: May 6, 2014

(54) LOW DROPOUT VOLTAGE REGULATOR INCLUDING A BIAS CONTROL CIRCUIT

(75) Inventor: Petr Kadanka, Valasska Bystrice (CZ)

(73) Assignee: Semiconductor Components Industries, LLC, Phoenix, AZ (US)

( * ) Notice: Subject to any disclaimer, the term of this patent is extended or adjusted under 35 U.S.C. 154(b) by 136 days.

(21) Appl. No.: 13/291,397

(22) Filed: Nov. 8, 2011

(65) Prior Publication Data

US 2013/0113447 A1 May 9, 2013

(51) Int. Cl.

| | |
|---|---|
| ***G05F 1/00*** | (2006.01) |
| ***G05F 1/56*** | (2006.01) |
| ***G05F 1/563*** | (2006.01) |
| ***G05F 1/565*** | (2006.01) |

(52) U.S. Cl.

CPC *G05F 1/56* (2013.01); *G05F 1/563* (2013.01); *G05F 1/565* (2013.01)

USPC ..... 323/274; 323/280

(58) Field of Classification Search

USPC ..... 323/273, 274, 280, 281, 268

See application file for complete search history.

(56) References Cited

U.S. PATENT DOCUMENTS

| | | | | |
|---|---|---|---|---|
| 6,157,176 | A * | 12/2000 | Pulvirenti et al. | 323/266 |
| 6,426,613 | B1 | 7/2002 | Kadanka | |
| 6,556,083 | B2 | 4/2003 | Kadanka | |
| 6,806,690 | B2 * | 10/2004 | Xi | 323/273 |
| 6,933,772 | B1 | 8/2005 | Banerjee et al. | |
| 6,979,984 | B2 * | 12/2005 | Perrier et al. | 323/281 |
| 7,071,667 | B2 * | 7/2006 | Itohara | 323/284 |
| 7,714,553 | B2 * | 5/2010 | Lou | 323/276 |
| 7,932,707 | B2 | 4/2011 | Imura | |
| 8,098,057 | B2 * | 1/2012 | Morino | 323/269 |
| 8,289,009 | B1 * | 10/2012 | Strik et al. | 323/272 |
| 8,344,713 | B2 * | 1/2013 | Shrivas et al. | 323/273 |
| 2008/0224675 | A1 * | 9/2008 | Takagi | 323/275 |
| 2009/0066306 | A1 * | 3/2009 | Noda | 323/282 |
| 2010/0148735 | A1 | 6/2010 | Napravnik | |

* cited by examiner

*Primary Examiner* — Gary L Laxton
*Assistant Examiner* — Kyle J Moody
(74) *Attorney, Agent, or Firm* — Polansky & Associates, P.L.L.C.; Paul J. Polensky

(57) ABSTRACT

A low dropout (LDO) regulator includes a voltage regulation loop for providing an output voltage to an output terminal, where the output voltage is proportional to a reference voltage. The voltage regulation loop includes a current bias input for receiving a bias current. The LDO regulator also includes a bias current control circuit for providing the bias current at a first value when the reference voltage is greater than a feedback voltage and at a second value higher than the first value when the reference voltage is less than the feedback voltage.

17 Claims, 4 Drawing Sheets

- PRIOR ART -

LOW DROPOUT VOLTAGE REGULATOR INCLUDING A BIAS CONTROL CIRCUIT

FIELD

The present disclosure is generally related to low dropout voltage regulators (LDOs) and, more particularly, to low power LDOs having low quiescent current.

BACKGROUND

Voltage regulators may be used in a variety of electrical circuits and may operate under a wide variety of different load conditions. A voltage regulator is typically designed to provide a regulated output voltage regardless of the impedance of the load coupled to the output terminal of the voltage regulator. A rapid change to the load impedance, such as by connecting a load to the output, can cause a transient change in the output voltage.

Low power LDOs can be designed with adaptive bias to improve their dynamic performance in response to such transient changes at high output currents. However, low power LDOs are often driven by a very low bias current such that, when the transient is first received at the output terminal, the output stage of the low power LDO has a relatively slow dynamic response to the transient event as the bias current increases.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

An embodiment of a circuit is described below with respect to FIG. 2 that provides an output stage for a low power LDO regulator with enhanced dynamic response to varying load conditions. The circuit includes uses a comparator having a first input with a small offset which observes the output voltage through a voltage divider and a second input for receiving a reference voltage. The output of the comparator switches a current bias for the output stage and concurrently pulls down the gate of the power transistor. Thus, the bias current of the circuit is determined as a function of the actual level (undershoot) of the output voltage. The dynamic of the load transient response is not given by the LDO voltage regulator output stage itself, but rather is determined by the velocity of the comparator.

Low power LDOs can be designed with adaptive bias to improve their dynamic performance at high output currents. An example of such a circuit is described below with respect to FIG. 1.

Figure 1:
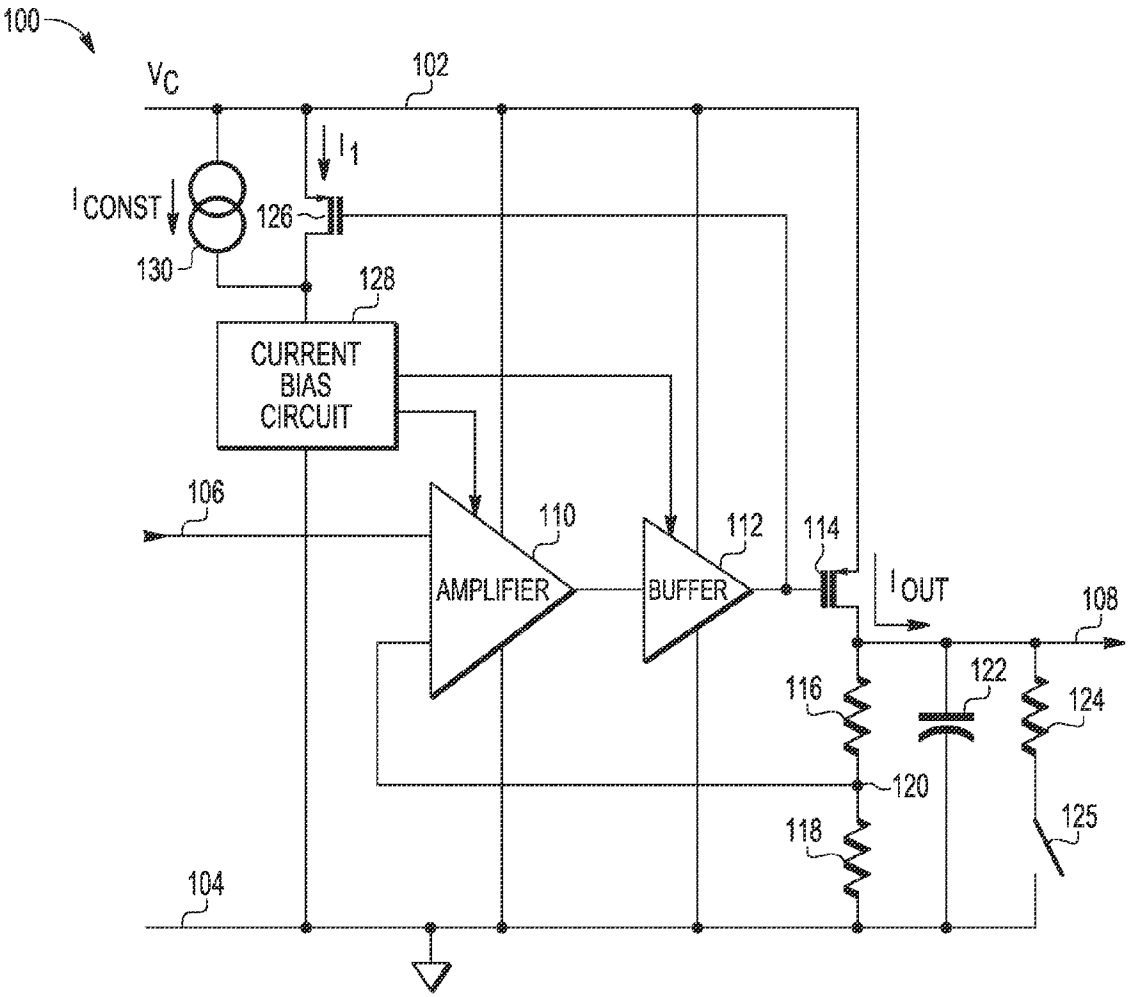
FIG. 1 is a partial block and partial circuit diagram illustrating the output stage of a conventional LDO regulator.

FIG. 1 is a partial block and partial circuit diagram illustrating the output stage 100 of a conventional LDO regulator. Output stage 100 includes a first supply terminal 102 for providing a first voltage potential (Vc) and a second power supply terminal 104 for providing a second voltage potential (such as ground (gnd)). Output stage 100 further includes an input terminal 106 for receiving a reference voltage and an output terminal 108 for providing a regulated output voltage and output current ($I_{OUT}$). Output stage 100 includes an amplifier 110 having a first input connected to the input terminal 106, a second input connected to node 120, and an output connected to an input of a buffer circuit 112, which is a unity gain buffer and which has an output connected to a gate of a transistor 114 for providing a gate drive signal. In the illustrated example, transistor 114 is a p-channel metal oxide semiconductor field effect transistor (PMOSFET) having a source connected to first power supply terminal 102, a gate connected to the output of buffer circuit 112, and a drain connected to output terminal 108.

Output stage 100 further includes a voltage divider circuit including a resistor 116 having a first terminal connected to output terminal 108 and a second terminal connected to node 120. Voltage divider circuit further includes a resistor 118 having a first terminal connected to node 120 and a second terminal connected to second supply terminal 104.

Output stage 100 is connected to a capacitor 122, which has an electrode connected to output terminal 108 and a electrode connected to second supply terminal 104. Further, output terminal 108 is connected to a load 124, which can be selectively connected to second supply terminal 104. Load 124 and switch 125 represent a switched output load that, when connected to output terminal 108 may produce a transient signal on output terminal 108. The combination of load 124 and switch 125 represents a load that quickly changes its current, producing a transient on output terminal 108. However, such a current-varying load may be provided by other types of circuits, such as a current sink load that has an abrupt change of its current.

Output stage 100 further includes a bias current circuit including a constant current source 130 for providing a substantially constant current ($I_{CONST}$) and a second current source for providing a current ($I_1$) that is proportional to the output current ($I_{OUT}$). The second current source is provided by transistor 126 including a source connected to first power supply terminal 102, a gate connected to the gate of transistor 114, and a drain connected to a current bias circuit 128. Transistor 126 provides a first current ($I_1$) that is proportional to the output current ($I_{OUT}$) at output terminal 108. Current bias circuit 128 includes circuitry to mirror the sum of the substantially constant current ($I_{CONST}$) and the current ($I_1$) to produce bias currents, which are provided to current bias inputs of amplifier 110 and buffer circuit 112.

In the illustrated example, a variable portion of the bias current is provided by the first current ($I_1$) through transistor 126, which is in parallel with transistor 114. In this arrangement, the first current ($I_1$) is proportional to the output current ($I_{OUT}$). Constant current source 130 supplies a substantially constant portion of the bias current ($I_{CONST}$). In an example, when a load (such as resistive load 124) is switched, there is an abrupt change in the output current, which produces a quick change in the bias current ($I_1$ plus $I_{CONST}$) flowing into the current bias circuit 128 during the transition from low to high with respect to the output current ($I_{OUT}$). This increase in the bias current results in a corresponding increase to the bias currents provided to the current bias inputs of amplifier 110 and buffer circuit 112, providing enhanced dynamic performance (i.e., relatively better transient response).

In an output stage having a low quiescent current (i.e., a very low bias current), the output stage 100 of the LDO voltage regulator receives (detects) the transient at a point where it has a very low bias current. The impact of the increased bias current on the amplifier 110 takes time, which can result in a slow response to the relatively fast transient in output current ($I_{OUT}$).

While the above-described circuit arrangement provides a bias current that increases in proportion to the output current ($I_{OUT}$) providing a dynamic response that limits the voltage drop on the output terminal 108 in response to the switched resistive load 124, it is possible to further enhance the dynamic response of the output stage. An example of an output stage having an improved dynamic response is described below with respect to FIG. 2.

Figure 2:
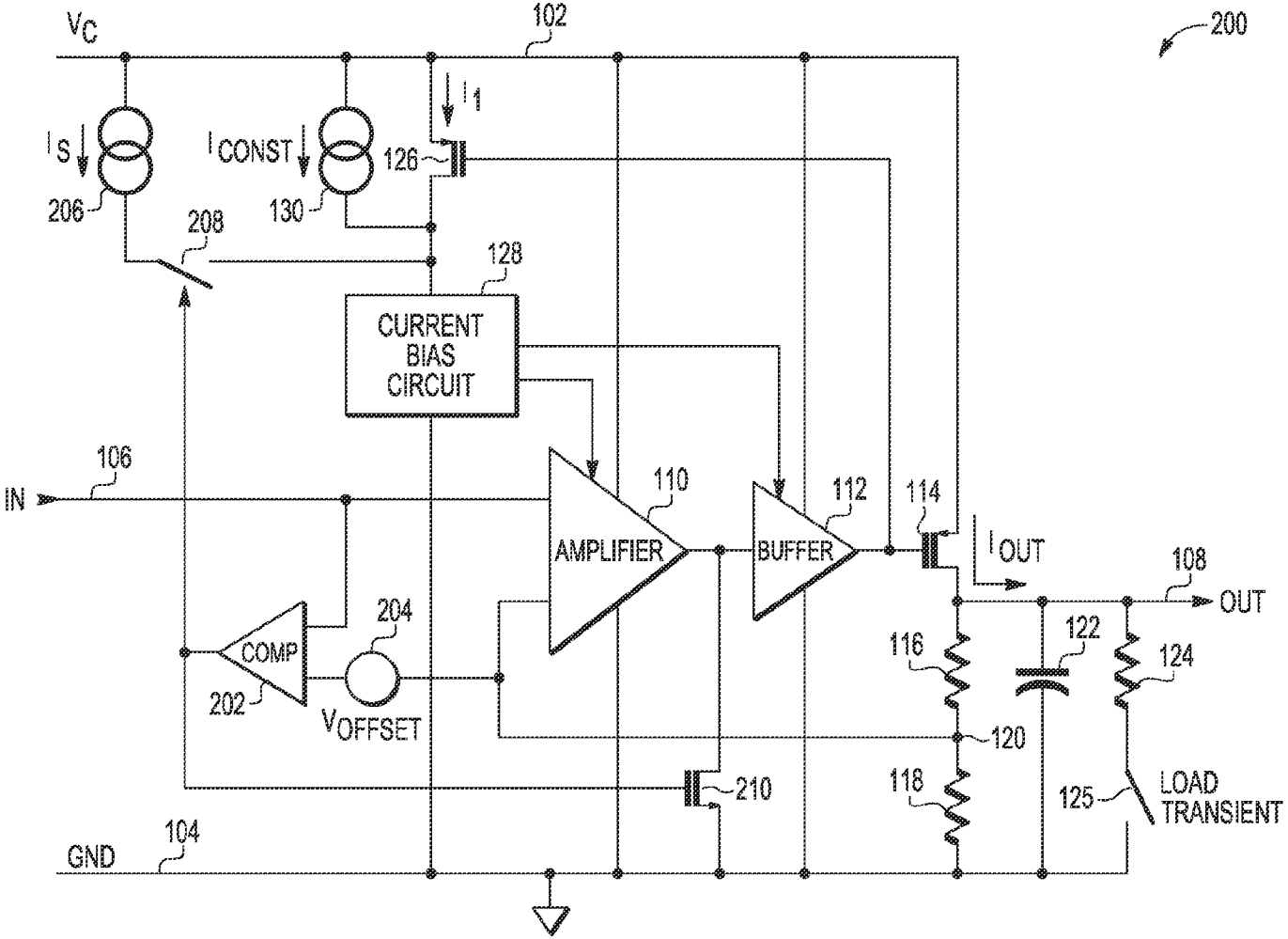
FIG. 2 is a partial block and partial circuit diagram of an output stage of an LDO regulator including a comparator with a small offset and a switched current source.

FIG. 2 is a partial block and partial circuit diagram of an output stage 200 of an LDO regulator including a comparator 202 with a small offset and a switched current source. Output stage 200 includes all of the elements of output stage 100 in FIG. 1 with the addition of a comparator 202, a voltage offset 204, a current source 206, a switch 208, and a pulldown transistor 210. The output stage 200 includes a voltage regulation loop having an amplifier 110, a buffer circuit 112, a transistor 114, and a voltage divider including resistors 116 and 118 for providing an output voltage to output terminal 108. The output voltage is proportional to a reference voltage provided to a first input of amplifier 110. The voltage regulation loop also includes a current bias input for receiving a bias current. The output stage further includes a current bias control circuit having a comparator 202, an offset voltage source 204, a current source 206, a switch 208, and a current bias circuit 128 for providing the bias current to enhance dynamic performance of the output stage 200.

Comparator 202 includes a first input connected to input terminal 106, a second input connected to a first terminal of offset voltage source 204, which has a second terminal connected to the second input of amplifier 110. Comparator 202 includes an output connected to a control terminal of switch 208 for providing a comparator output signal or switch control signal. The control terminal of switch 208 represents a control input of the current bias control circuit. Switch 208 includes a first current electrode connected to a first terminal of current source 206 and a second current electrode connected to current bias circuit 128, and switch 208 cooperates with current source 206 to provide a switchable current source that is selectively coupled to the current node at the input of the current bias circuit 128. Current source 206 also includes a second terminal connected to first power supply terminal 102. The output of comparator 202 is also connected to a gate of pulldown transistor 210. Pulldown transistor 210 includes a drain connected to the input of buffer circuit 112 and a source connected to second power supply terminal 104.

In an example, the comparator 202 with offset voltage source 204 observes a differential voltage between an input voltage on the input terminal 106 and a voltage on the node 120 plus the offset voltage source 204. In other words, comparator 202 observes a differential voltage between an input voltage and a voltage representative of an output voltage. Comparator 202 produces a logic high signal at its output when the voltage at node 120 differs from the voltage on input terminal 106 by more than a threshold (which is set by offset voltage source 204). When comparator 202 produces a logic high signal, switch 208 is closed, connecting current source 206 to the current bias circuit 128, adding the current from current source 206 to the first current ($I_1$) and the substantially constant current ($I_{CONST}$), thereby increasing a sum of currents provided to current bias circuit 128, which mirrors the sum of currents a bias currents to amplifier 110 and buffer circuit 112. The mirrored currents represent current bias signals applied to amplifier 110 and buffer circuit 112. Additionally, the logic high signal biases transistor 210 to conduct current, pulling down the voltage at the input of buffer circuit 112, thereby pulling the voltage on the gate of transistor 114 to ground. The low voltage of the input of buffer circuit 112 biases transistor 114 to conduct more current, increasing the output current ($I_{OUT}$) and causing the output voltage across resistors 116 and 118 and at node 120 to increase as well.

In operation, the output of comparator 202 switches the additional bias current ($I_S$) provided by the current source 206 to a node at the input of current bias circuit 128, thus increasing the current provided to the entire output stage 200. The dynamic of the transient response of the output stage 200 is not given by the LDO output itself, but rather is determined by the velocity of comparator 202. Further, by biasing transistor 210 to pull down the voltage level at the input of buffer circuit 112 and to pull down the voltage level on the gates of transistors 114 and 126, transistors 126 and 114 conduct more current and provide additional improvement in the speed of the transient response of output stage 200.

In the illustrated example, if the voltage differential between input terminal 106 and output node 120 is greater than the offset, comparator 202 activates switch 208 and pulldown transistor 210, increasing the sum of the currents provided to the current bias circuit 128 and decreasing the gate voltage on the gate terminal of transistor 114, thereby increasing the output current ($I_{OUT}$) and the bias current to improve the dynamic response. When the voltage at the output terminal is less than the offset (i.e., when the transient is over or the output current has stabilized), comparator 202 turns off switch 208 and deactivates transistor 210, allowing the unity gain buffer circuit 112 to track the output of amplifier 110, returning to normal operation.

In an example, when the reference voltage at the first input of comparator 202 is approximately the same as the voltage at the second input of the comparator 202, comparator 202 opens switch 208 disconnecting current source 206 from the current bias circuit 128. In this instance, current bias circuit 128 receives a substantially constant current ($I_{CONST}$) from constant current source and a current ($I_1$) from a second current source, such as a transistor 126, which provides a current ($I_1$) that is proportional to the output current. The constant current ($I_{CONST}$) and the current ($I_1$) are combined at a current node at the input of current bias circuit 128, providing a combined current at a first current level.

When the reference voltage at the first input of comparator 202 differs from the voltage at the second input of comparator 202 by more than the offset voltage, comparator 202 provides a signal at its output that closes switch 208, connecting current ($I_S$) from current source 206 to a node connected to constant current source 130 and current source, such as transistor 126, which node is connected to an input of current bias circuit 128. The sum of the currents ($I_S$+$I_{CONST}$+$I_1$) is provided to the current node at the input of current bias circuit 128, which mirrors the sum of the currents to the current bias inputs of amplifier 110 and buffer circuit 112, enhancing their dynamic response. In this instance, the sum of the currents (or the combined currents) is at a second value higher than the first value when switch 208 is open.

In the illustrated embodiment, the offset voltage source 204 is connected between the second input of comparator 202 and node 120. In this instance, a reference voltage on input terminal 106 is used by amplifier 110 and comparator 202, in which case the reference voltage is the same at both inputs. However, it is possible to provide a first reference to the input of amplifier 110 and a second reference to the first input of comparator 202. In an alternative embodiment, the offset voltage source 204 is connected between the input terminal 106 and the first input of comparator 202 and the second input of comparator 202 is connected to node 120. In this instance, the offset voltage source 204 provides the second reference. Thus, depending on the implementation, the reference voltages provided to the input of the amplifier 110 and the comparator 202 may be the same or may be different but related, for example, by an offset voltage.

Node 120 provides a feedback voltage or feedback signal to the second input of amplifier 110 and to the second input of comparator 202 (optionally via offset voltage source 204). Amplifier 110 produces an output voltage (or drive signal) on its output responsive to a difference between the feedback signal and the reference voltage on input terminal 106. Buffer circuit 112 is a unity gain buffer that provides whatever is on its input to its output, thus buffering the drive signal to the gate of transistor 114.

Figure 3:
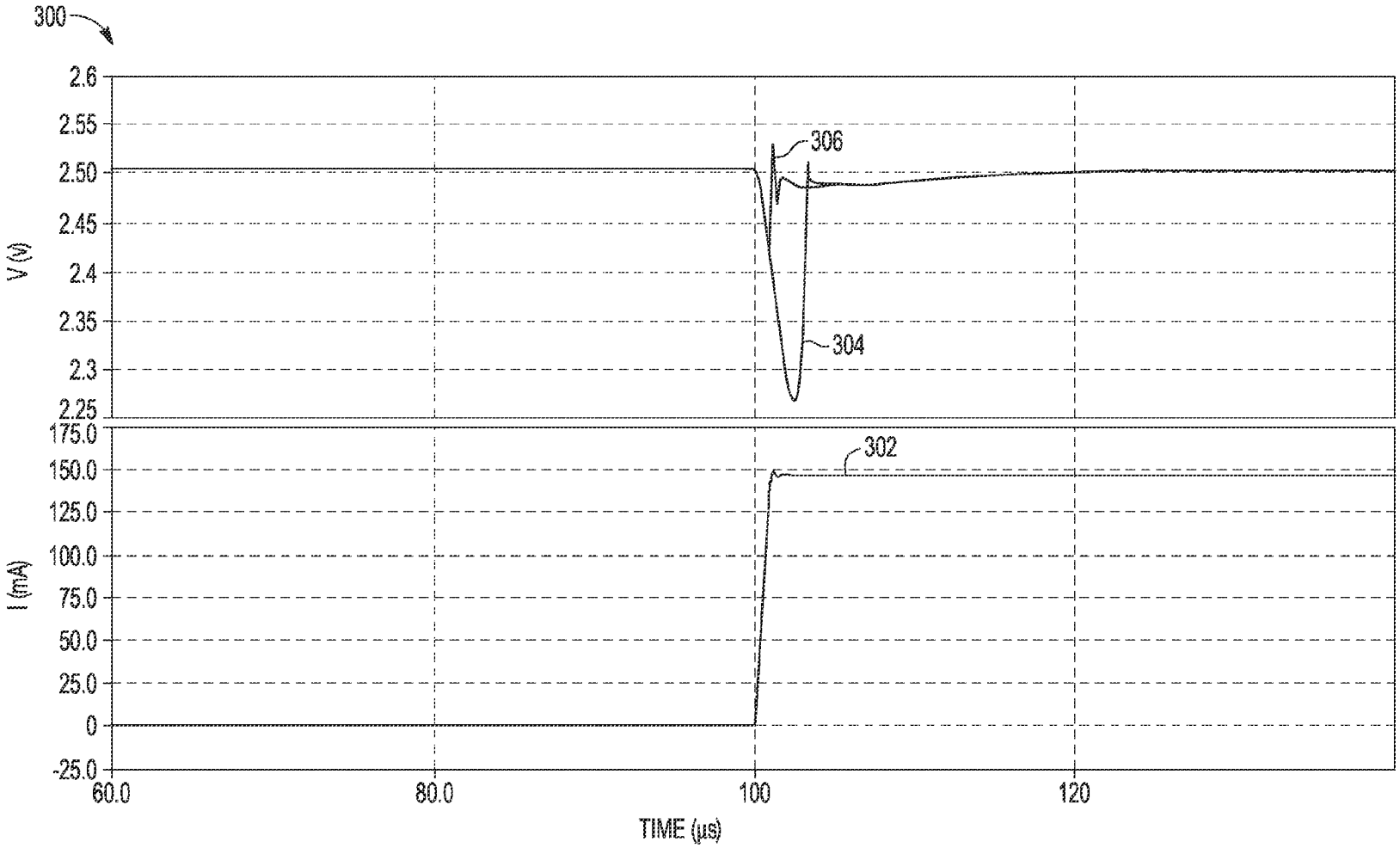
FIG. 3 depicts a graph of current versus time illustrating an abrupt change in the output current and a graph of voltage versus time illustrating the resulting output voltages on the output terminal of the LDO regulators of FIGS. 1 and 2.

FIG. 3 depicts a graph 300 of current versus time illustrating an abrupt change in the output current 302 and a graph of voltage versus time illustrating the transient response voltage on the output terminal of the LDO regulators of FIGS. 1 and 2. Graph 300 depicts an abrupt change in the output current 302 at a time of approximately 100 μs, which causes the voltage on output terminal 108 of output stage 100 in FIG. 1 to decrease abruptly as generally indicated at 304. With the abrupt step increase of the output current, there is a corresponding, proportional change to the bias current into current bias circuit 128 that is mirrored to amplifier 110 and buffer circuit 112. However, while the increased bias current enhances dynamic performance, the very low initial bias current results in a slow response to the fast transient in the output current.

In contrast, as generally indicated at 306, the output voltage of output stage 200 in FIG. 2 adjusts more rapidly than output stage 100 in part because the load transient response is not given by the output itself, but is given by the velocity of comparator 202, which controls switch 208 to drive additional current from current source 206 into the current bias circuit 128, which mirrors the sum of the currents to the amplifier 110 and the buffer circuit 112. The additional bias current from current source 206 provides a larger bias current to the amplifier 110 and the buffer circuit 112, enhancing their dynamic response. Additionally, when the switch 208 is closed, the input of buffer circuit 112 is coupled to ground through transistor 210, thereby pulling the gate voltage on the gate of transistor 114 low, biasing transistor 114 to conduct more current, which pulls the output voltage up as indicated by 306 in graph 300.

In general, comparator 202 activates switch 208 and transistor 210, based on a difference between the reference voltage on input terminal 106 and the voltage at node 120. As the output current ($I_{OUT}$) increases and the output voltage increases, the comparator 202 open switch 208 and turn off current flow through transistor 210, allowing the voltage at the input of buffer circuit 112 to rise, which throttles the output current ($I_{OUT}$). This dynamic feedback tied to the output at node 120 leads to some brief oscillations as the voltage regulation loop operates to stabilize the output voltage. However, the resulting output signal reaches a stable level much faster using the output stage 200 of FIG. 2 (as indicated at 306) as compared to the output stage 100 of FIG. 1 (indicated by line 304).

Figure 4:
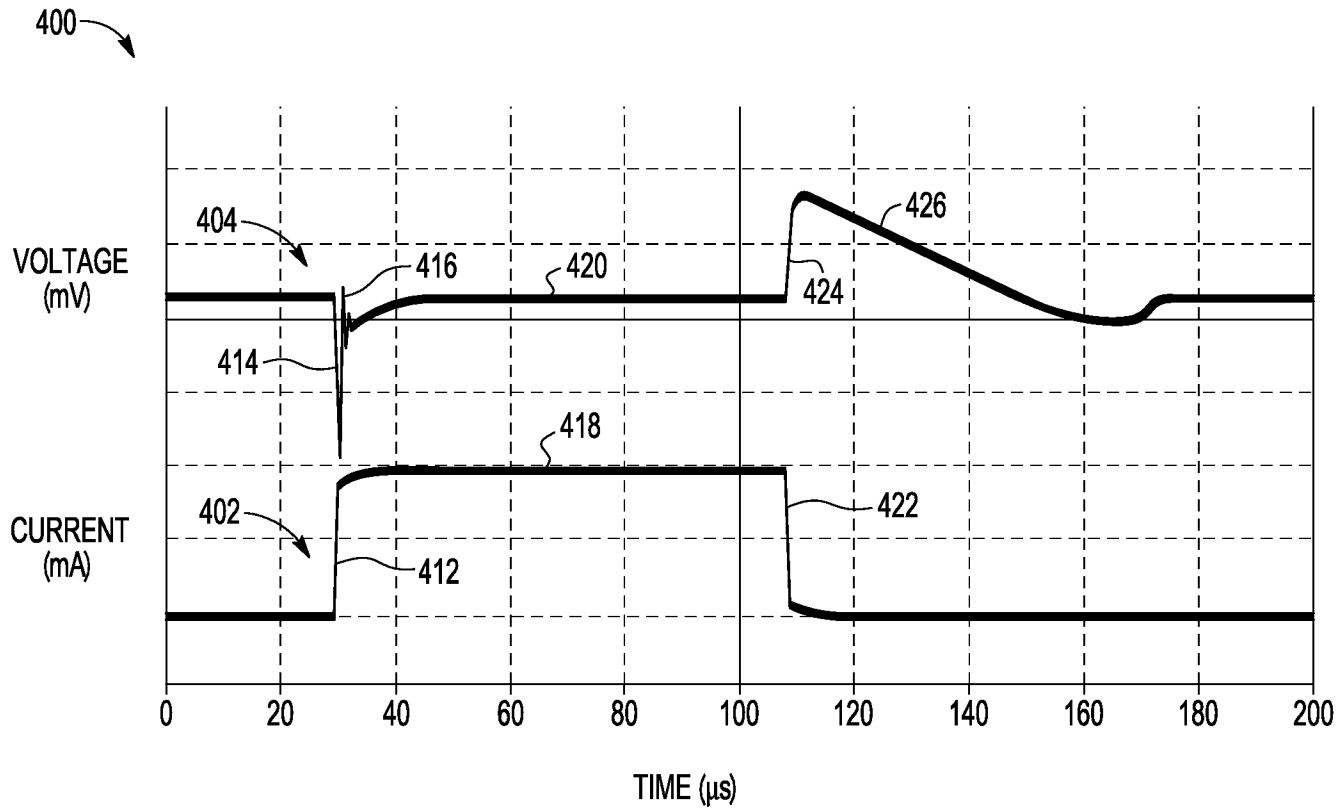
FIG. 4 is a graph of a load transient voltage versus time and the output current versus time measured from the output terminal of the LDO regulator of FIG. 2.

FIG. 4 is a graph 400 of a load transient voltage 404 versus time and the output current ($I_{OUT}$) 402 versus time measured from the output terminal of the LDO regulator of FIG. 2. Output current ($I_{OUT}$) 402 changes abruptly (low to high) at 412, resulting in the undershoot 414 of the output voltage. Once the output voltage exceeds the desired voltage level (as indicated at 416), the output stage 200 adjusts the voltage on the gate of transistor 114 to stabilize the output current ($I_{OUT}$) at an appropriate current level, and the output voltage also settles at the regulated voltage level as indicated at 420.

At 422, the output current 402 transitions as indicated by transition edge 422 from a high level at 418 to a low level. This drop in the output current ($I_{OUT}$) 402 may be caused by disconnection of a load, such as resistive load 124. As the output current 402 decreases, the current flowing through transistor 114 causes the output voltage to rise, resulting in the overshoot 424 of the output voltage. When the voltage at node 120 exceeds the reference voltage on input terminal 106 minus offset voltage 204 ($V_{OFFSET}$), comparator 202 turns off switch 208, allowing the voltage on the input of buffer circuit 112 to rise, which reduces current flow through transistor 114, causing the load transient voltage 404 to decrease as indicated at 426. Over time, the bias current returns to a quiescent state that includes the constant current ($I_{CONST}$) and the current ($I_1$) that is proportional to the output current ($I_{OUT}$), at which point the output voltage stabilizes.

In the above-discussion, a low dropout regulator (LDO) includes an output stage that dynamically adjusts its current consumption based on the state of the output voltage and/or output current. A combined current is formed from a constant current ($I_{CONST}$), a current ($I_1$) that is proportional to the output current, and a switched current ($I_S$) that is optionally provided. The combined current is provided to a node that is connected to a current bias circuit 128. Current bias circuit 128 can be a current mirror circuit having a first leg connected to the node, a second leg connected to a current bias input of amplifier 110, and a third leg connected to a current bias input of buffer circuit 112. The second and third legs are configured to produce bias currents that are proportional to one another and to the combined current on the first leg. A comparator 202 compares an input voltage to an output voltage and controls a switch to selectively provide the switched current ($I_S$) to the node.

In general, the current bias circuit 128, in conjunction with a constant current source 130, a proportional current source, such as transistor 126, and optionally the switched current ($I_S$) from current source 206 through switch 208 control how much current the circuit elements consume for their respective functions. The bias currents provided to amplifier 110 and buffer circuit 112 have a big impact on the dynamic performance, or velocity, of the circuit.

In an embodiment, a comparator circuit includes a comparator 202 with a small offset voltage source 204, which observes the output voltage and operates to control a switch to adjust the current bias such that the current bias is given by the actual level (undershoot) of the output voltage. The reference voltage of the comparator 202 is given directly by the voltage reference of the LDO regulator. The output of the comparator 202 switches the additional current ($I_S$) for the entire output stage, causing a "velocity" of the comparator 202 to define the dynamic of the load transient response. Additionally, the output of the comparator 202 pulls down the gate of the output transistor 114, providing additional improvement to the transient response.

Although the present invention has been described with reference to preferred embodiments, workers skilled in the art will recognize that changes may be made in form and detail without departing from the scope of the invention.

What is claimed is:

1. A low dropout (LDO) regulator comprising:

a voltage regulation loop for providing an output voltage to an output terminal by changing a conductivity of an output transistor in response to a difference between a feedback voltage and a reference voltage, the feedback voltage proportional to the output voltage, the voltage regulation loop including an amplifier having a current bias input for receiving a bias current; and a bias current control circuit for providing the bias current to the current bias input, wherein the bias current control circuit comprises:

a first current source for providing a substantially constant current to a node;

a second current source for providing a variable bias current proportional to an output current on the output terminal to the node; and a switched current source for providing an additional current to the node when the reference voltage is greater than the feedback voltage by more than an offset voltage, wherein the bias current control circuit provides the bias current to the current bias input in response to a total current into the node.

2. The LDO regulator of claim 1, wherein the switched current source comprises:

a comparator including a first input for receiving the reference voltage, a second input, and an output for providing a comparator output signal; and an offset voltage source including a first terminal for receiving the feedback voltage and a second terminal coupled to the second input of the comparator, the switched current source responsive to the comparator output signal for providing the additional current to the node.

3. The LDO regulator of claim 1, wherein:

the amplifier has a first input for receiving the reference voltage, a second input for receiving the feedback voltage, an input forming the current bias input, and an output, the amplifier to provide the output voltage on the output responsive to the difference between the feedback voltage and the reference voltage; and the output transistor includes a first current electrode for receiving an input voltage, a control terminal coupled to the output of the amplifier, and a second current electrode coupled to the output terminal.

4. The LDO regulator of claim 3, wherein the voltage regulation loop further comprises a buffer circuit including an input coupled to the output of the amplifier and an output coupled to the control terminal of the output transistor.

5. The LDO regulator of claim 1, wherein the bias current control circuit further comprises:

a current mirror circuit including a first terminal coupled to the node and a second terminal coupled to the current bias input, the current mirror configured to provide the bias current proportional to a sum of currents at the node coupled to the current bias input of the voltage regulation loop.

6. The LDO regulator of claim 5, wherein the switched current source comprises:

a third current source configured to provide the additional current;

a switch including a first current electrode coupled to the third current source, a control terminal, and a second current electrode coupled to the node; and and wherein the bias current control circuit further comprises:

a comparator having a first input for receiving the reference voltage, a second input for receiving a voltage representative of the feedback voltage, and an output coupled to the control terminal of the switch for providing a switch control signal; and wherein the switch is responsive to the switch control signal to selectively provide the additional current to the node.

7. The LDO regulator of claim 6, wherein:

the amplifier has a first input for receiving the reference voltage, a second input for receiving the feedback voltage, a current bias input forming the current bias input of the voltage regulation loop, and an output;

the voltage regulation loop further comprises a buffer including an input coupled to the output of the amplifier, and an output;

the output transistor including a first current electrode for receiving an input voltage, a control terminal coupled to the output of the buffer, and a second current electrode for providing the output voltage to the output terminal; and the voltage regulation loop further comprises a transistor including a first current electrode coupled to the output of the amplifier, a control terminal coupled to the output of the comparator, and a second current electrode coupled to a power supply terminal, the transistor responsive to the switch control signal to couple the output of the amplifier to the power supply terminal.

8. A low dropout (LDO) regulator comprising:

an amplifier having a first input for receiving a reference voltage, a second input for receiving a feedback voltage proportional to an output voltage, a current bias input, and an output for providing a gate drive signal;

a buffer including an input coupled to the output of the amplifier, and an output;

an output transistor including a first current electrode for receiving an input voltage, a control terminal coupled to the output of the buffer, and a second current electrode for providing the output voltage on an output terminal;

a comparator circuit having a first input for receiving the reference voltage, a second input for receiving the feedback voltage, and an output for providing a comparator output signal when the reference voltage is greater than the feedback voltage by more than an offset voltage; and a bias control circuit having an input coupled to the output of the comparator circuit and having an output coupled to the current bias input of the amplifier, the bias control circuit to provide a current bias signal in response to the comparator output signal, wherein the bias control circuit comprises:

a first current source for providing a substantially constant current to a current node;

a second current source for providing a variable current to the current node, the variable current proportional to an output current on the output terminal;

a third current source for providing a third current; and a switch including a first terminal coupled to the third current source, a second terminal coupled to the current node, and a control terminal forming the input of the bias control circuit, the switch responsive to the comparator output signal to selectively couple the third current to the current node.

9. The LDO regulator of claim 8, further comprising a transistor including a first current electrode coupled to the output of the amplifier, a second current electrode coupled to a power supply terminal, and a control terminal coupled to the output of the comparator.

10. The LDO regulator of claim 9, further comprising a voltage divider including:

a first resistor having a first terminal coupled to the second current electrode of the transistor, and a second terminal for providing the feedback voltage; and a second resistor having a first terminal coupled to the second terminal of the first resistor and a second terminal coupled to the power supply terminal.

11. The LDO regulator of claim 8, wherein the output of the amplifier is coupled to the control terminal of the output transistor through a buffer circuit.

12. The LDO regulator of claim 8, further comprising a current mirror circuit including a first terminal coupled to the current node and including a second terminal coupled to the current bias input of the amplifier to provide a bias current proportional to a sum of currents at the current node.

13. The LDO regulator of claim 8, wherein the comparator closes the switch to couple the third current to the current node in response to detecting a transient on the output terminal and opens the switch to decouple the third current from the current node when the feedback voltage exceeds the reference voltage minus the offset voltage.

14. A low dropout (LDO) regulator comprising:

an amplifier including a first input for receiving a reference voltage, a second input for receiving a feedback voltage proportional to an output voltage, a bias input, and an output for providing a gate drive signal;

a current bias control circuit including a control input and including an output coupled to the bias input of the amplifier, the current bias control circuit configured to provide a bias current to the bias input, wherein the current bias control circuit comprises:

a first current source for providing a substantially constant current to a node;

a second current source for providing a second current to the node that is proportional to an output current;

a third current source for providing a third current;

a switch responsive to a bias control signal to selectively provide the third current to the node; and a current bias circuit for providing the bias current in response to a sum of the first, second, and third currents provided to the node, and a comparator circuit including a first input for receiving the reference voltage, a second input for receiving the feedback voltage, and an output coupled to the control input of the current bias control circuit, the comparator circuit to provide the bias control signal to the control input to control the current bias control circuit to provide the bias current at a first value when the reference voltage is greater than the feedback voltage by more than an offset voltage, and at a second value otherwise.

15. The LDO regulator of claim 14, wherein the comparator circuit comprises:

a comparator including a first input forming the first input of the comparator circuit, a second input, and an output forming the output of the comparator circuit; and an offset voltage source including a first terminal forming the second input of the comparator circuit and including a second terminal coupled to the second input of the comparator.

16. The LDO regulator of claim 14, further comprising a pulldown transistor including a drain coupled to the output of the amplifier, a gate coupled to the output of the comparator, and a source coupled to a power supply terminal.

17. The LDO regulator of claim 14, wherein the current bias control circuit comprises a current mirror including a first terminal coupled to the node and a second terminal coupled to the bias input of the amplifier.

* * * * *